United States Patent [19]

Morgan

[11] 3,961,758

[45] June 8, 1976

[54] CENTRIFUGAL PUMP WITH INTEGRAL GRINDER

[75] Inventor: Arvid E. Morgan, Mansfield, Ohio

[73] Assignee: Peabody Barnes, Inc., Mansfield, Ohio

[22] Filed: Aug. 23, 1974

[21] Appl. No.: 500,106

[52] U.S. Cl. ..... 241/46.11; 415/121 B; 415/215; 210/152; 417/424; 241/185 A

[51] Int. Cl.[2] ..... B02C 18/06

[58] Field of Search ..... 415/121 B, 215; 417/358, 359, 361, 424; 210/152; 241/46.11, 46.17, 185 A

[56] References Cited

UNITED STATES PATENTS

| | | | |
|---|---|---|---|
| 2,371,681 | 3/1945 | Durdin | 241/185 A |
| 2,644,403 | 7/1953 | Dawson | 415/121 B |
| 2,658,453 | 11/1953 | Walters | 241/46.17 |
| 3,128,051 | 4/1964 | Smith | 241/46.11 |
| 3,261,294 | 7/1966 | Schofield et al. | 415/215 |
| 3,324,800 | 6/1967 | Schroeder | 415/196 |
| 3,575,525 | 4/1971 | Fox | 415/215 |
| 3,650,481 | 3/1972 | Conery et al. | 241/46.11 |
| 3,667,692 | 6/1972 | Grace | 241/63 |
| 3,692,422 | 9/1972 | Girardier | 415/215 |

FOREIGN PATENTS OR APPLICATIONS

| | | | |
|---|---|---|---|
| 567,472 | 2/1945 | United Kingdom | 415/121 B |

*Primary Examiner*—C. J. Husar
*Attorney, Agent, or Firm*—Bosworth, Sessions & McCoy

[57] ABSTRACT

A submersible device for pumping liquids and liquid slurries and for concurrently grinding and comminuting solid and semi-solid material contained in the liquid product to be pumped. The device is generally located in a reservoir containing the liquid product, the reservoir being, for example, a sewage collection tank in a positive pressure sewage system. The liquid product is initially shredded by a cutter bar and then drawn upwardly through a grinding and comminuting section where an abrasive drum mounted on a rotary drive shaft cooperates with an interior cylindrical stator surface to grind and comminute solids and semi-solids contained in the liquid product. From the grinding section, the resulting slurry is drawn into a centrifugal pump section with an impeller having a frusto-conical pumping face formed with symmetrical pumping cavities that are operable in both directions of rotation. The pumping face of the impeller cooperates with a corresponding interior frusto-conical stator surface to shear and pump the liquid product. In the pump section the product is propelled radially and angularly outward and upward to a volute chamber that terminates in an outlet pipe connected to a pressure line.

14 Claims, 6 Drawing Figures

CENTRIFUGAL PUMP WITH INTEGRAL GRINDER

BACKGROUND OF THE INVENTION

This invention relates to the combined functions of pumping liquids and liquid slurries and the preliminary comminution and grinding of solids and semi-solids contained in the product prior to its being pumped so as to minimize the danger of clogging in the pump and pressure lines. More particularly, the invention relates to an improved rotary pumping and grinding unit wherein a centrifugal type pump impeller and a rotary grinder and comminutor mechanism are driven by a common rotary shaft and arranged in cooperating successive relationship.

The invention has particular utility in connection with pressure sewage systems wherein a slurry of liquid sewage with some solid and semi-solid material therein, stored in a sewage collection tank, is to be pumped through pressure sewage lines and consequently must be ground and comminuted prior to delivery to a centrifugal pump stage in order to avoid clogging of the pump and pressure lines.

The type of submersible rotary grinding and pumping units to which the invention relates generally have a sealed motor housing and an electrical motor with a vertical, downwardly extending rotary output shaft that extends through a surrounding annular stator section for the grinder and centrifugal impeller sections. The material enters the unit through a downwardly facing axial inlet spaced, for example, about two inches from the bottom of the tank and a cutter or shredder bar or other rotary grinding member is mounted at the lower end of the rotary shaft in the path of the material to be pumped. The centrifugal impeller for the pumping section is mounted above the grinder member and is adapted to create a suction to draw the product through the grinder section and propel it radially outward to a circumferential volute chamber that terminates in an outlet pipe.

In the case of pressure sewage systems, the grinder or shredder section must comminute such solid material as bone, sticks, glass, bottle caps, cans, nylon garments, rags, wood and similar foreign matter that generally loads up and clogs conventional pumps. The problem of clogging can occur, for example, where the liquid product makes a 90° turn from axial to radial flow at the point where the liquid passes from the grinder section to the centrifugal pump section. The abrupt directional change creates turbulence and reduces the output pressure head.

Another disadvantage inherent in prior art, pumps with shredders and abraders of the type described is that these devices are vulnerable to abrasive action and chipping of cooperating pump surfaces due to the highly abrasive material that may be contained in the product to be pumped. The same abrasive action is apt to cause wear of the impeller and stator surfaces and eventually reduce the output pressure due to improper clearances between the two cooperating surfaces.

The apparatus of the present invention reduces the difficulties described above and affords other features and advantages heretofore not obtainable.

SUMMARY OF THE INVENTION

It is among the objects of the invention to provide a combined centrifugal pump and rotary grinder for use in grinding and pumping liquids and liquid slurries containing the solid or semi-solid material with minimum pressure drop in the centrifugal pump section and thus an increased output pressure head.

Another object of the invention is to provide a device of the type described above with improved grinding and comminution of solid and semi-solid material prior to delivery of the product to the pumping section.

Still another object is to provide a device of the type described above wherein the impeller of the centrifugal pump section is effective both to shear and to pump the material in either direction of shaft rotation.

A further object is to provide a combined rotary grinding mechanism and centrifugal pump wherein the spacing between the stator and centrifugal impeller surfaces of the pumping section may be readily adjusted to compensate for wear etc.

These and other objects are accomplished by the novel construction of the invention which comprises an apparatus for pumping liquids and liquid slurries from a reservoir and for grinding and comminuting solid and semi-solid material contained in the product to be pumped, the pumping and grinding sections being arranged in axially aligned relation and the rotary drive deriving from a common rotary shaft.

The apparatus includes a housing that defines a volute chamber terminating in an outlet pipe, and a drive motor with an output shaft that extends vertically downward from the motor. An annular stator coaxial with the drive shaft and threadly received in the housing, is adapted for axial adjustment relative to the housing to adjust the spacing between working parts of the pump section. The stator has an outwardly extending radial flange with an upwardly facing interior frusto-conical surface and an interior cylindrical surface coaxial with the shaft with a plurality of axially extending slots formed therein through which the liquid product may pass. A cutter bar for initially shredding the material is preferably mounted on the bottom of the shaft. A grinder element having an abrasive outer cylindrical surface is mounted on the lower portion of the shaft within the stator and cooperates with the interior cylindrical surface of the stator to comminute solid and semi-solid material passing upwardly between the grinder element and the stator.

A centrifugal impeller is mounted on the shaft above the grinder element and has a downwardly facing frusto-conical exterior impeller surface closely spaced from the upwardly facing frusto-conical stator surface for shearing the material entering the pumping section and for propelling the liquid product radially outward and axially upward from the grinder section to the volute chamber.

The operating surface of the impeller is provided with symmetrical pumping cavities that are operable in either direction of shaft rotation so that the unit may be alternatingly or periodically reversed to minimize jamming and prolong life.

DESCRIPTION OF THE PREFERRED INVENTION

Figure 1:
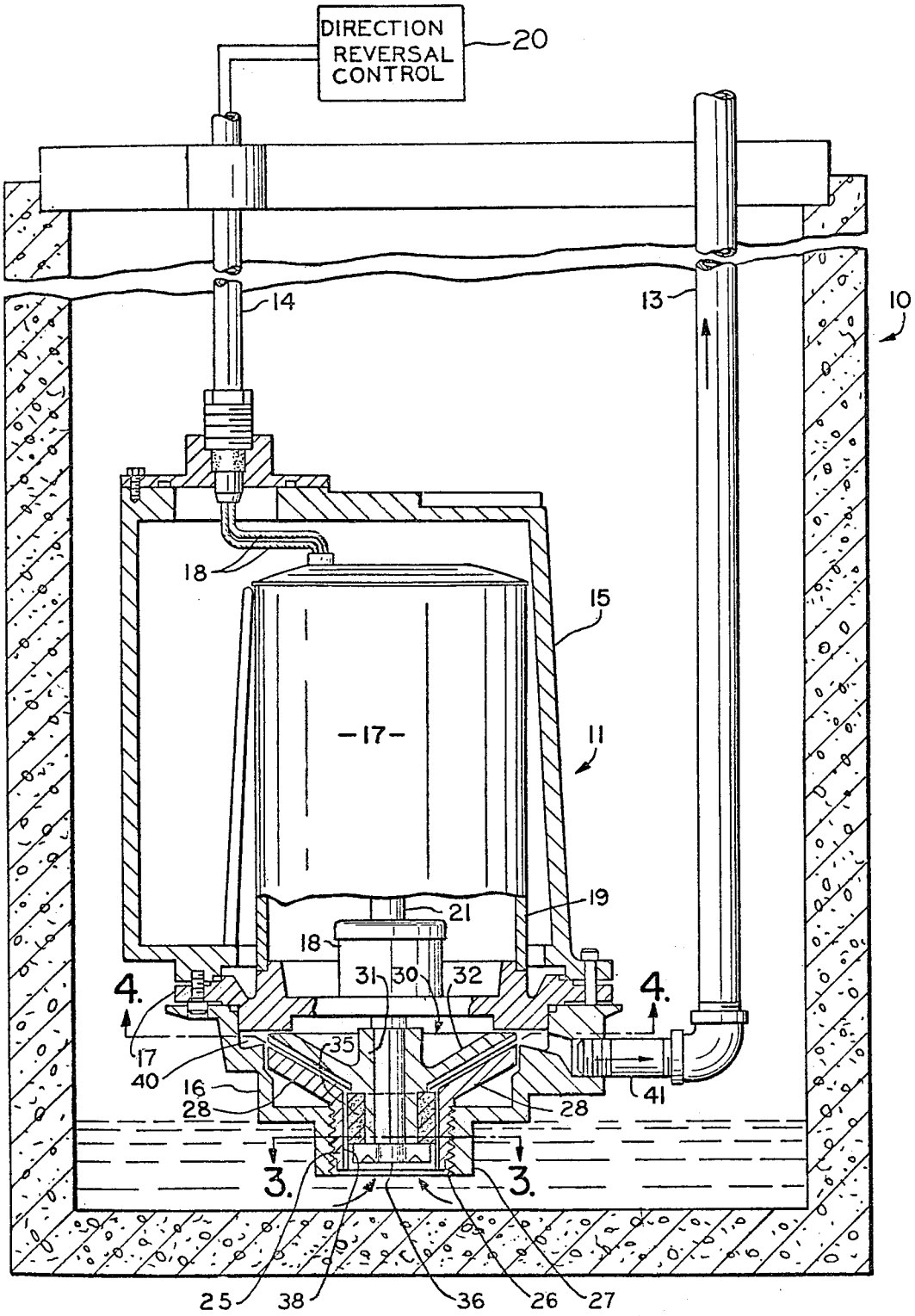
FIG. 1 is a sectional view showing a sewage collection tank with a grinder pump unit embodying the invention located therein.

For the purpose of illustration, the invention is shown and described herein as used in association with a pressure sewage system wherein liquid sewage containing solid and semi-solid material is ground or comminuted and then pumped through pressure sewage lines in the form of a slurry. The pressure sewage system serves a waste generating unit and is adapted to process sewage that is gravity fed to a sewage collection tank and then pumped through pressure lines to a previously installed gravity sewer system. Normally, the sewage is gravity fed through a four inch sewer pipe from the waste generating unit to the sewage collection tank and then pumped from the tank through a 1 inch to 1½ inch discharge pipe.

Referring more particularly to the drawings, there is shown a sewage collection tank 10 adapted to receive sewage through an inlet pipe (not shown), and mounted within the tank 10 is a grinder pump 11 embodying the invention. The tank 10 has a cover 12 through which extends a 1 inch to 1½ inch diameter outlet pipe 13 forming part of the pressure sewage line, and a protective conduit 14 for electrical lines that supply power to the grinder pump 11.

Figure 2:
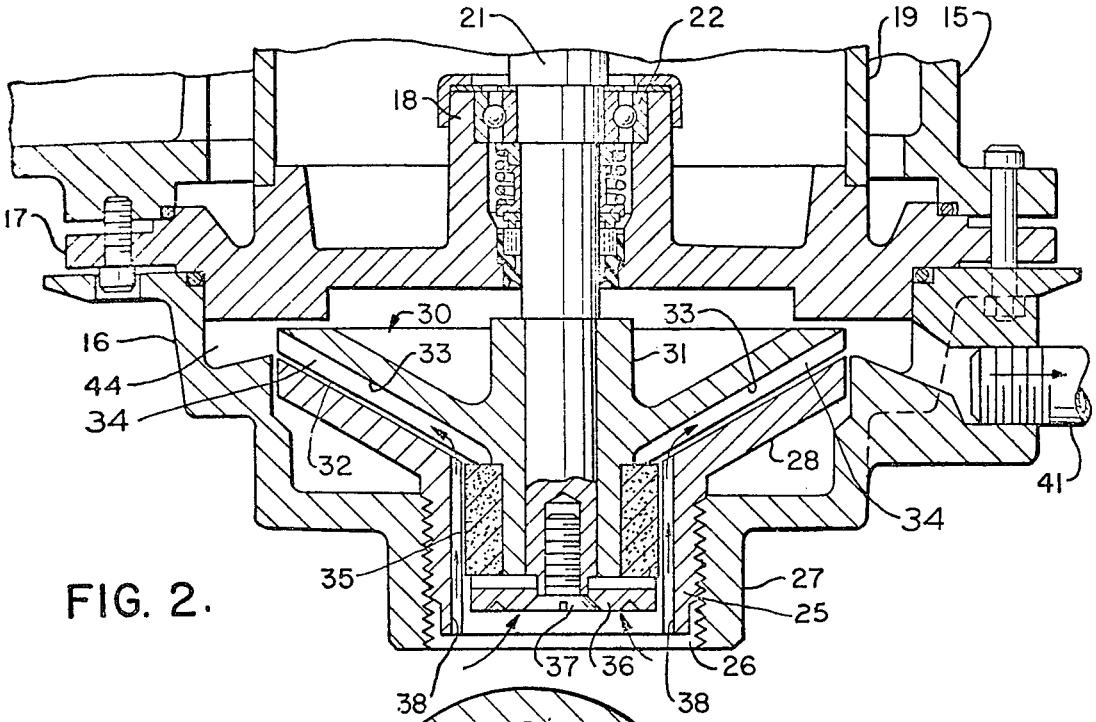
FIG. 2 is a sectional view on an enlarged scale illustrating the comminuting and pumping sections of the unit of FIG. 1.
Figure 3:
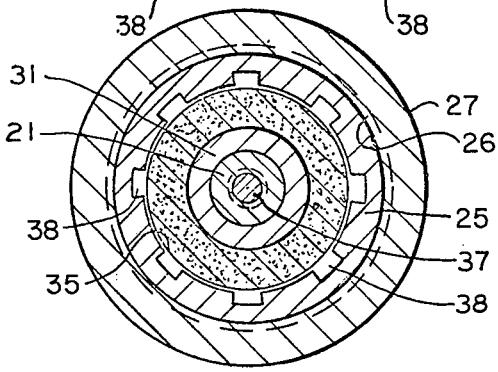
FIG. 3 is a sectional view to an enlarged scale taken on the line 3—3 of FIG. 1.
Figure 4:
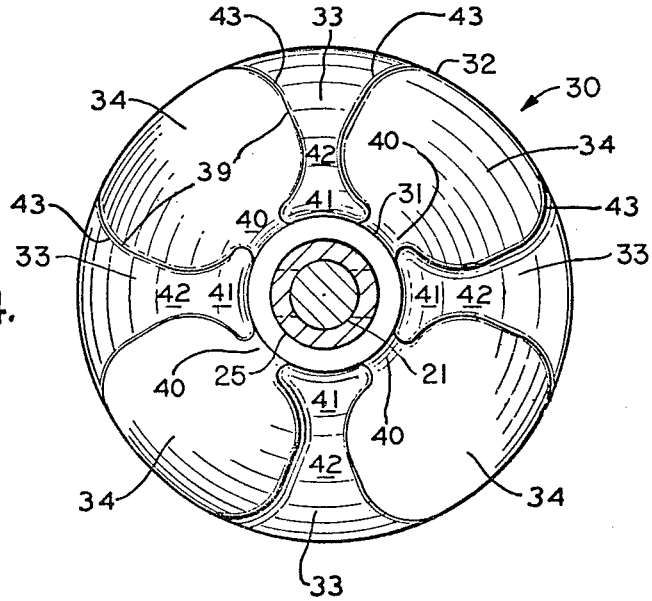
FIG. 4 is a sectional view to an enlarged scale taken on the line 4—4 of FIG. 1.
Figure 5:
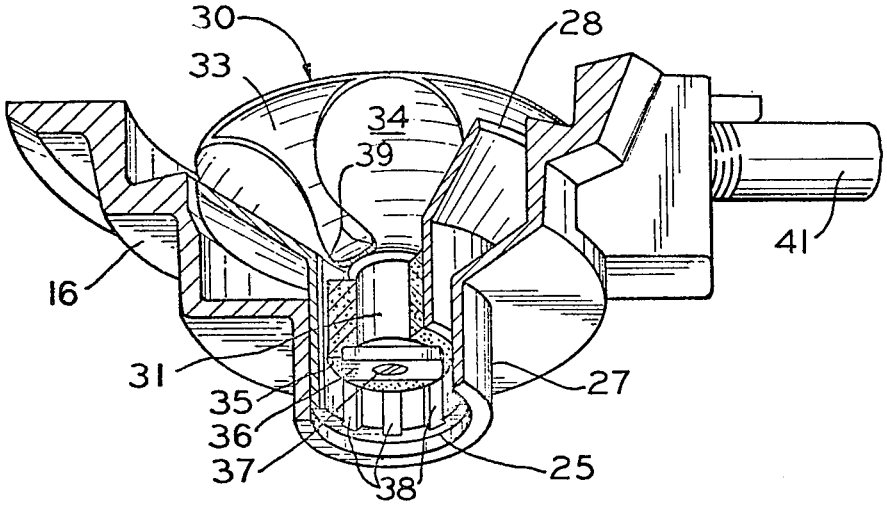
FIG. 5 is a fragmentary perspective view from below of the grinder pump unit of FIGS. 1 to 4 with parts broken away and shown in section for the purpose of illustration.
Figure 6:
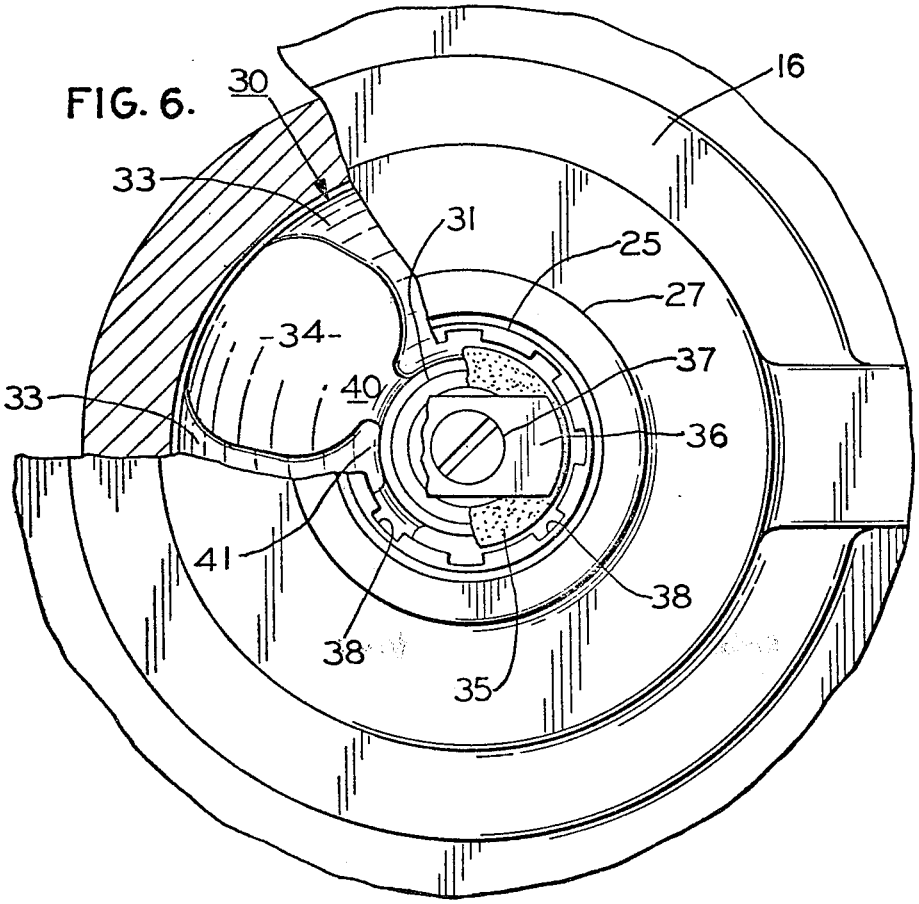
FIG. 6 is a fragmentary elevational view from below on an enlarged scale, of the unit of FIGS. 1 to 5 with parts broken away.

The grinder pump 11 has a cylindrical casing 15, a pump body 16 and a bearing and seal plate 17 all bolted together and clamped in sealing relation as illustrated in FIGS. 1 and 2. The bearing and seal plate 17 has a bearing housing sleeve 18 formed in its innermost portion as best illustrated in FIG. 2. Mounted on the bearing and seal plate 17 within the cylindrical casing 15 is a cylindrical motor housing 19 for a reversible electric drive motor (not shown). The space within the casing 15 surrounding the motor is filled with a dielectric oil that protects the motor from the sewage in the tank 10. Power leads from the tubular conduit 14 extend through the motor housing to the motor and are preferably protected by the cylindrical casing 15 from contact with sewage in the collection tank 10. The power leads are connected to a direction reversal control 20 which in the preferred form causes the unit to operate in the opposite direction than before upon each new actuation.

The motor has an output shaft 21 journaled in a sealed roller bearing unit 22 mounted within the bearing housing 18 of the bearing and seal plate 17. The output shaft 21 extends vertically downward through the pump body 16 and drives the rotary operating elements of the grinder pump 11 as will be described in detail below.

A stator 25 which functions in connection with both the grinding section and the centrifugal pump section is located within the pump body 16 and is threadedly received in a threaded inlet passage 26 coaxial with the shaft 21 and defined by a downwardly extending boss 27 at the lower end of the pump body 16. The stator 25 has a frusto-conical shaped flange 28 at its upper portion defining a cone angle of about 120° and extending radially outward and upward within the pump head 16.

The axial position of the stator can be adjusted by rotating it so as to thread it axially upward or downward to obtain the proper axial location as will be described in more detail below.

Mounted on the motor shaft 21 is a centrifugal impeller 30 with a tubular body 31 and an annular frusto-conical impeller plate 32 extending radially outward and axially upward from the tubular body 31 to define a 120° cone angle corresponding to that of the flange 28 of the stator 25. The outer frusto-conical surface of the impeller 30 has four symmetrical pumping cavities 33 defined by symmetrical radial lands 34 formed therein to give the impeller a bi-directional capability. As indicated above, the motor preferably drives the impeller 30 in opposite directions on alternate actuations in response to the direction reversing control 20 to obtain uniform wear and also to prevent jamming in the event of clogging, for example. The reversing control circuitry is conventional and of a type well known to those skilled in the art.

Mounted coaxially with the lower end of the tubular body 31 of the impeller 30 is a cylindrical grinding drum 35 formed of abrasive material such as silicon carbide. The grinding drum 35 is tightly clamped in place on the lower end of the tubular body 31 by a cutter bar 36 which is mounted on the end of the motor output shaft 21 by a machine screw 37 which is threaded into a threaded axial bore in the end of the shaft. Sewage with solid and semi-solid material entrained therein that enters the inlet passage 27 encounters the cutter bar 36 which preliminarily shreds it as it is sucked upward by the pump section.

The interior surface of the stator has circumferentially spaced axial slots 38 formed therein to accommodate passage of the sewage between the grinding drum 35 and the interior cylindrical surface of the stator 25. The liquid product drawn past the cutter bar 36 progresses through the axial slots 38 and solid or semi-solid material carried with it is abraded and comminuted by the grinding drum 35.

The resulting slurry is drawn into the centrifugal pump section wherein the whirling impeller plate 32 of the centrifugal impeller 30 cooperates with the closely adjacent frusto-conical interior surface of the upper flange 28 of the stator 25 to afford an additional shearing of the material leaving the slots 38 at the upper end of the stator 25. The lands 34 of the impeller 32 are shaped to provide effective pumping action in both directions and to give a final shearing effect on any solid or semi-solid material remaining in the slurry as it leaves the slots 38 in the stator 25. Preferably, the edges 39 of the lands 34 are shaped generally as shown in the drawings, the edges on each land being mirror images of each other. The lands 34 are necked down as at 40 to provide a narrow portion that sweeps over the slots 38 with a shearing action. The necking down of the lands 34 in this region permits adequate flow of the pumped fluid through the slots since the spaces 33 in the region of the slots are wider, as indicated at 41, so that each pumping cavity 33 of the impeller 32 is always in communication with at least one slot 38 of the stator 25.

Progressing radially outwardly from the necked in portions 40 of the lands 34, the lands are increased in width and the pumping cavities 33 are decreased in width reaching a minimum in the regions indicated at 42. The reduced cross sectional area of the cavities 33 in these zones controls the rate at which fluid can be pumped by the impeller 32 and prevents overloading of the drive motor that might occur in the event that the impeller permitted the pumping of an excessive volume of fluid. Radially outwardly from the zones 42, the width of the cavities 33 again increases and the edge surfaces of the lands 34 are curved as shown at 43 to provide approximately the desired exit angle for fluid leaving the rotor and being discharged into the volute 44 in either direction of rotation of the pump. Thus, the shape of the lands 34 with the large land area of the impeller 32 coupled with the necked down portions overlying the slots 38 provides for a further comminution of the material being pumped as it leaves the slots 38, proper control of the rate of flow by the reduced width of the pumping cavities 33 in the regions 42 and efficient pumping action that is enhanced by the curved portions 43 near the periphery of the rotor. All of these features operate in either direction of rotation of the impeller.

The pumping cavities 33 are effective to pump the slurry in a radially outward and axially upward direction requiring about a 60° angular change of direction in the flow path of the liquid product from the grinding section to the pumping section. From the impeller plate 32, the slurry is propelled to a circumferential volute chamber 44 defined by the pump body 16 and the lower surface of the bearing and seal plate 17. The volute chamber 44 does not comprise a true volute but rather has a circular form so as to be of equal effectiveness in either direction of shaft rotation. The volute chamber 44 terminates in an outlet fitting 45 connected to the pump body 16. The change in flow direction from the impeller element 30 to the volute chamber is approximately 30° as viewed in vertical section so that, as will be seen, no abrupt 90° change in direction of the flow path is encountered by the slurry passing between the two sections of the unit 11.

The unique, bi-directional construction of the impeller 30, particularly as to the sharp edges of the lands 34, affords a particularly advantageous final shearing effect as to any solid or semi-solid material remaining in the slurry as it exits the slots 38. The two inner edges 39 of each land 34 face in opposite directions so that one inner edge 39 of each land 34 is always providing a shearing function. The clearance between the frusto-conical upper surface of the stator flange 28 and the lands 34 is adjusted to a clearance of about 0.005 inch to optimize the shearing action. As indicated above this clearance can be adjusted by turning the stator 25 relative to the pump body 16.

The grinder pump unit thus described is adapted for high pressure heads of up to 100 feet of water, for example, and has a low volumetric capacity, e.g., from 5 to 10 gallons per minute. As indicated above, the drive motor is reversible and runs alternately in opposite directions, changing direction each time the motor is energized after being stopped. This affords a self-cleaning feature for the grinder and pump and essentially doubles the edges used to achieve the shearing and grinding effect to substantially increase the effective life of the unit.

A principle advantage of the construction thus described, is that the stator 25 is threadedly mounted in the pump head 16 and thus may be adjusted and readjusted axially relative to the impeller plate 32 as necessary. This permits adjustment of the spacing between the impeller plate 32 and the cooperating frusto-conical stator surface to compensate for wear that might occur due to abrasive matter in the liquid product being pumped and also to permit fine adjustment of the spacing for optimum pump efficiency.

While the invention has been shown and described herein with respect to a specific embodiment thereof this is intended for the purpose of illustration rather than limitation and other modifications and variations in the specific form herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

I claim:

1. Apparatus for pumping liquids and liquid slurries and for comminuting solid and semi-solid material contained therein comprising:

a housing defining a volute chamber and an outlet therefrom, a drive motor, a rotary drive shaft extending vertically downward from said motor, a stator coaxial with said shaft and adapted for axial adjustment relative to said housing, said stator having an upwardly facing frusto-conical surface and an interior cylindrical surface coaxial with said shaft and having a plurality of axially extending slots formed therein, means defining an inlet communicating with the lower ends of said slots in said stator, a grinding member having an abrasive outer cylindrical surface mounted on the lower end of said shaft within said stator and cooperable therewith to comminute solid and semi-solid material passing upwardly from said inlet through said slots between said grinder element and said stator, a centrifugal impeller mounted on said shaft above said grinding member and having a downwardly facing frusto-conical exterior impeller surface cooperable with said upwardly facing stator surface for pumping material radially outward and axially upward to said volute chamber, said downwardly facing impeller surface having radially extending lands that define pumping cavities therebetween, said lands having edges in cooperating relation with said slots to sweep past the upper ends of said slots and to shear solid and semi-solid matter contained in said slurry.

2. Apparatus as defined in claim 1 wherein said lands are symmetrical in shape and wherein each land has two oppositely facing cutting edges whereby one of said two edges serves a shearing function in each direction of rotation of said impeller.

3. Apparatus as defined in claim 2 wherein said pumping cavities are symmetridal about a generatrix of the frusto-conical surface of the impeller, said cavities having a relatively wide inner portion in the vicinity of said ends of said slots whereby each of said slots is in communication with at least one of said cavities at all times during rotation of said impeller, a relatively narrow neck portion outwardly of said inner portion to control the rate of fluid flow and prevent overloading of said drive motor, and an outer portion that increases progressively in width outwardly from said neck portion to afford a fluid exit angle whereby fluid flow changes from a generally radial direction to a generally tangential direction.

4. Apparatus as defined in claim 3 wherein said impeller has four of said pumping cavities.

5. Apparatus as defined in claim 2 including control means for operating said drive motor in the opposite direction from its last rotation upon each actuation thereof.

6. In a centrifugal pump including a rotary drive means, an inlet for a liquid product to be pumped and a volute chamber communicating with an outlet, the improvement which comprises:

a stator with a frusto-conical interior surface having an outer circumferential portion adjacent said volute chamber and an inner circumferential portion with a plurality of liquid inlets symmetrically spaced therearound, a centrifugal impeller operatively connected to said drive means and having a frusto-conical exterior impeller surface in matching correspondence to and cooperable with said frusto-conical stator surface for pumping liquid product radially outward and axially upward to said volute chamber, said impeller surface having a plurality of radially extending lands that define pumping cavities therebetween, said lands having cutting edges that sweep past said liquid inlets to shear solid and semi-solid matter contained in said liquid product.

7. A pump as defined in claim 6 wherein said lands are symmetrical in shape about a generatrix of said frusto-conical surface and wherein each land has two oppositely facing cutting edges whereby one of said two edges serves a shearing function in each direction of rotation of said impeller.

8. A pump as defined in claim 6 wherein said pumping cavities are symmetrical about a generatrix of the frusto-conical surface of the impeller, said cavities having a relatively wide inner portion in the vicinity of said liquid inlets whereby each of said inlets is in communication with at least one of said cavities at all times during rotation of said impeller, a relatively narrow neck portion outwardly of said inner portion to control the rate of fluid flow and prevent overloading of said drive motor, and an outer portion that increases progressively in width outwardly from said neck portion to afford a fluid exit angle whereby fluid flow changes from a generally radial direction to a generally tangential direction.

9. Apparatus for pumping liquids and liquid slurries and for comminuting solid and semi-solid material contained therein comprising:

means defining a volute chamber terminating in an outlet, rotary drive means having a generally vertical axis, a rotary grinding member mounted on said drive means and having an abrasive outer cylindrical grinding surface, means defining an inlet for said liquid and liquid slurry to be pumped, means defining a stator surface surrounding and coaxial with said grinding member and cooperable therewith to comminute solid and semi-solid material from said inlet passing therebetween, said stator surface having axially extending slots, a centrifugal impeller mounted on said drive means above said grinding member and having a frusto-conical impeller face with radially extending lands that define pumping cavities therebetween, said lands having edges in cooperating relation with said slots to sweep past the upper ends of said slots and to shear solid and semi-solid matter contained in said slurry, means defining a frusto-conical stator surface cooperable with said impeller face for pumping the product from said grinding member radially outward and axially upward to said volute chamber, said frusto-conical stator surface being adjustable axially relative to said impeller.

10. Apparatus as defined in claim 9 wherein said grinding member comprises a cylindrical drum coaxially mounted on said drive means.

11. Apparatus as defined in claim 9 wherein said centrifugal impeller face has a downwardly facing exterior frusto-conical surface and said frusto-conical stator surface is an interior frusto-conical surface.

12. Apparatus as defined in claim 11 wherein said centrifugal impeller face defines a cone angle of about 120°.

13. Apparatus as defined in claim 9 wherein said means defining said frusto-conical stator surface is threadedly received in said housing and is adapted for axial adjustment when turned relative to said housing.

14. In a centrifugal pump including a rotary drive means, an inlet for a liquid product to be pumped and a volute chamber communicating with an outlet, the improvement which comprises:

a stator with a working surface having an outer circumferential portion adjacent said volute chamber and an inner circumferential portion with a plurality of liquid inlets symmetrically spaced therearound, a centrifugal impeller operatively connected to said drive means and having an impeller surface in matching correspondence to and cooperable with said stator working surface for pumping liquid product outward to said volute chamber, said impeller surface having a plurality of radially extending lands that define pumping cavities therebetween, said lands having cutting edges that sweep past said liquid inlets to shear solid and semi-solid matter contained in said liquid product.

* * * * *